US009902512B2

(12) United States Patent
Baroncini

(10) Patent No.: US 9,902,512 B2
(45) Date of Patent: Feb. 27, 2018

(54) REFINED DISTRIBUTOR UNIT

(75) Inventor: Ivano Baroncini, Castel San Pietro Terme (IT)

(73) Assignee: I.M.A. INDUSTRIA MACCHINE AUTOMATICHE SPA, Ozzano Dell'Emilia (IT)

( * ) Notice: Subject to any disclaimer, the term of this patent is extended or adjusted under 35 U.S.C. 154(b) by 960 days.

(21) Appl. No.: 13/637,311

(22) PCT Filed: Mar. 14, 2011

(86) PCT No.: PCT/EP2011/053803

§ 371 (c)(1),
(2), (4) Date: Sep. 25, 2012

(87) PCT Pub. No.: WO2011/120790

PCT Pub. Date: Oct. 6, 2011

(65) Prior Publication Data

US 2013/0008131 A1 Jan. 10, 2013

(30) Foreign Application Priority Data

Mar. 31, 2010 (IT) ..... MI2010A0552

(51) Int. Cl.
*B65B 35/12* (2006.01)
*B65B 59/04* (2006.01)
(Continued)

(52) U.S. Cl.
CPC ..... *B65B 35/12* (2013.01); *B65B 59/04* (2013.01); *B65B 5/103* (2013.01); *B65B 9/045* (2013.01); *Y10T 403/10* (2015.01)

(58) Field of Classification Search
CPC ..... B65B 5/103; B65B 9/045; B65B 35/12; B65B 35/06; B65B 59/04; B65B 1/363;
(Continued)

(56) References Cited

U.S. PATENT DOCUMENTS 964,782 A * 7/1910 Hull ..... A01C 7/04 221/224
1,448,826 A * 3/1923 Bruchey ..... B65B 5/103 221/265
(Continued)

FOREIGN PATENT DOCUMENTS

JP 57-066797 4/1982
JP 10-277801 10/1998
WO 20090115445 A1 9/2009

OTHER PUBLICATIONS

International Search Report for PCT Application PCT/EP2011/053803. European Intellectual Property Office, May 9, 2011.

*Primary Examiner* — Stephen F Gerrity
*Assistant Examiner* — Joshua Kotis
(74) *Attorney, Agent, or Firm* — Mannava & Kang, P.C.

(57) ABSTRACT

Refinements made to distributor units which serve to continuously transfer and position tablets or pills in organized alveoli in an advancing strip, the advancing strip presenting its alveoli on each occasion in correspondence with holes positioned radially in a distributor disk. The distributor disk having holes is associated with a motor which supplies a rotation motion by an intermediate connector. The intermediate connector is connected stably to the distributor disk and detachably, by an intermediate member, to the motor which supplies the rotation motion.

12 Claims, 4 Drawing Sheets

(51) Int. Cl.
*B65B 5/10* (2006.01)
*B65B 9/04* (2006.01)

(58) Field of Classification Search
CPC ..... B65B 2009/047; Y10T 403/10; D06F 37/302; F16D 1/00; F16D 1/02; F16D 1/04; F16D 1/076; F16D 1/08; F16D 3/68; F16D 1/0876; A61J 7/02; H02K 7/003
USPC ..... 53/235, 250, 246; 198/867.15; 222/367, 222/370; 221/265, 203, 258, 237, 277, 221/167; 403/359.6, 355, 1
See application file for complete search history.

(56) References Cited

U.S. PATENT DOCUMENTS 1,495,178 A * 5/1924 Hodgdon ..... B65B 5/103 221/264
2,457,220 A * 12/1948 Fowler ..... A61J 7/02 222/164
2,507,883 A * 5/1950 Blackman ..... A61J 7/02 221/224
2,515,594 A * 7/1950 Fischman ..... A61J 7/02 221/199
2,777,561 A * 1/1957 German ..... B65B 35/46 198/393
2,801,025 A * 7/1957 Cookson ..... A61J 7/02 221/169
2,930,509 A * 3/1960 Hall ..... B65B 57/20 221/169
3,281,012 A * 10/1966 Martell ..... B65B 35/56 221/172
3,545,164 A * 12/1970 Middleton ..... B65B 5/103 221/156
3,628,694 A * 12/1971 Nichols ..... B65B 11/50 221/265
3,724,165 A * 4/1973 Nichols ..... B65B 5/103 53/250
3,944,137 A * 3/1976 Cutchins ..... A01C 7/00 111/900
4,024,058 A * 5/1977 Derckx ..... A23G 7/00 209/625
4,474,488 A * 10/1984 Pinkerton ..... E21B 17/046 175/414
4,711,605 A * 12/1987 Hodlewsky ..... F16D 1/0876 403/355
5,014,877 A * 5/1991 Roos ..... B65G 47/1407 221/203
5,086,945 A * 2/1992 Corella ..... B65B 35/06 221/13
5,323,929 A * 6/1994 Marlar ..... A61J 7/0409 221/121
6,065,893 A * 5/2000 Montanez, Jr. ..... B60B 3/147 192/69.43
6,467,853 B1 * 10/2002 Swartzendruber ..... F16D 1/08 301/111.04
7,219,703 B2 * 5/2007 Geltser ..... B65G 47/1428 141/102
7,341,010 B1 * 3/2008 Friestad ..... A01C 7/046 111/185
2002/0014053 A1 * 2/2002 Kim ..... B65B 1/363 53/154
2002/0104741 A1 8/2002 Buckley et al.
2006/0201109 A1 9/2006 Van Eenoo
2009/0057186 A1 * 3/2009 Willard ..... B65B 5/103 206/538
2009/0218363 A1 * 9/2009 Terzini ..... A61J 7/02 221/4

* cited by examiner

REFINED DISTRIBUTOR UNIT

FIELD OF THE INVENTION

The present invention concerns refinements made to distributor units and to a relative refined distributor unit. The present invention is applied, in particular, but not only, to distributors of the compact type.

The distributors to which the invention refers are used industrially for the continuous distribution and the positioning of tablets or pills or other similar products of various shapes and sizes, in suitable alveoli or seatings predisposed in an advancing strip.

BACKGROUND OF THE INVENTION

Distributor units are known, and also those of the compact type, which are used to position the distribution of tablets or pills in packets of the blister type, for example for the pharmaceutical or food sector, or other sector having similar needs.

Said distributor units use distributor discs suitably predisposed for the synchronized release of the tablets into a strip which advances and which has suitable seatings to accommodate said tablets.

In the following description, the term tablets shall also include pills, capsules and other products of similar or comparable type or size.

By distributor units of the compact type we mean units having a compact shape, as for example described in WO-A1-2009/115445.

These distributor units are studied and made so as to work a wide variety of types and shapes of tablets to guarantee a considerable production, in order to reduce the intervention times of ordinary maintenance, to make the tablets travel the smallest path possible thus generating less wear, and to reduce the bulk and consumption.

Precisely because of these characteristics, the basic adjustments must remain stable over time and the periodic adjustments (for example the periodical zero setting) have to be carried out without further controls and tuning, so as to affect the production cycle very little.

In the case of compact distributor units, the reduced spaces they entail are difficult to reconcile with fine-tuning interventions, adjustment and control, carried out in short times, if not programmed.

Compact distributor units, precisely because of their characteristics, therefore need a new way of conceiving and making the components in order to allow a correct functioning, to maintain the production advantage and to make a simple and quick start-up.

After a long period of trials and experiments with multiple new solutions, that is, solutions applied and conceived in a different way. Applicant has perfected the present inventive idea making a distributor unit that is functional, efficient and with reduced maintenance, as well as a constant high performance, while still keeping the easy disassembly, quick and safe replaceability of the distributor disk, without requiring particular zero setting controls.

In particular, the Applicant has found that the distributor disk has to be quick and easy to replace, at the same time guaranteeing, without particular attention or specific interventions, characteristics of planarity, vertical positioning, duration of the fine tuning, constancy in zero setting, as well as the constancy of response after every automatic zero reset. It should be noted that normally, although not always, in units such as these the zero reset is electric.

By zero reset we mean the coordination in time and position or the reciprocal initial positioning, of the distributor disk in relation to the other components with which it cooperates and coordinates.

A distributor disk of the type in question has a plurality of parallel rows, disposed circumferentially, of holes organized and suitably predisposed, having shapes and sizes coherent with the shape of the tablets which must be treated. The organized holes are disposed radially on the surface of the distributor disk.

In the case of electric zero setting, that is coordination in time and position by means of electric systems, the disk normally has, along one circumference, means which allow the detection of the temporal position of the disk: said means may be, for example, holes, ridges, wedges etc.

The zero setting means are provided in a precise geometric ratio with the organized holes for the temporary housing of the tablets. In this type of organization, therefore, the position of a zero setting hole determines the position of the organized radial sequence of, the holes temporarily housing the tablets.

The Applicant therefore set himself the task of achieving a system, connected to the distributor disk, which allows to assemble and disassemble the distributor disk quickly, without further setting and adjustments, except for the automatic zero resetting described above, which is normally carried out by the machine every time it starts.

The distributor disk is made to rotate by a motor member at a speed coordinated with the linear advance of the strip on which the seatings or alveoli are made, where the tablets must be put.

The strip is organized in sequential sections on which the alveoli, also called blisters, are disposed in a prefixed manner.

The coordination requires that, each time, the reciprocal position of the temporary seatings present in the distributor disk coincides with the alveoli present in the advancing strip.

Advantageously but not necessarily, the motor member also confers on the distributor disk a vibrating function, so that the distributor disk also contributes to the correct positioning of the tablets in the organized holes present in the distributor disk. Moreover, depending or not on the size of the tablets, the distributor disk must position itself in a precise, desired, coplanar and positioning, ratio, with respect to said strip containing the alveoli.

Furthermore, after the substitution of the distributor disk, the shaft which brings the motion has to be in a precise position with respect to the references which serve to achieve the zero reset.

This means the substitution of the distributor disk must always and in any case guarantee the correct positioning of the disk, on each occasion required, both with respect to the strip which contains the alveoli and with respect to the member which imparts the motion to the distributor disk.

The present invention proposes to solve all these problems, and others which will be described in the following description, and allow to obtain a rapid and precise substitution of the distributor disk, at the same time allowing the correct positioning thereof, which does not require further fine tuning, except for zero setting.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants of the main inventive idea.

A refined distribution unit according to the present invention, whether of compact-type or not, is suitable to continuously transfer and position tablets, pills or similar in organized alveoli in an advancing strip. The advancing strip presents its alveoli on each occasion in correspondence with holes normally organized and positioned radially in a distributor disk. The distributor disk has zero setting means suitable for the coordination in time and position, or the reciprocal initial positioning, of the distributor disk in relation to the other components with which it cooperates and coordinates.

The distributor disk is made to rotate by means which supply the rotation motion thereto. Between said means which supply the rotation motion and the distributor disk there are intermediate connector, made in one or several parts which are separate from each other, and allow the rapid disassembly or reassembly of the distributor disk.

The intermediate connector are connected stably to the distributor disk and detachably to the means which supply the rotation motion.

According to the invention, as well as the usual attachment means, (for example screws), used to make the distributor disk solid with the intermediate connector, in the following also called intermediate means centering means are also provided.

The centering means enslave the distributor disk to the intermediate means in a desired and definite position, guaranteeing coaxiality of the distributor disk and the intermediate means, so that the motion imparted to the intermediate means by the means which supply the motion is coaxial to the distributor disk.

According to a variant, there are planar supporting or leveling means which guarantee that the distributor disk rotates on a plane orthogonal to the axis of rotation.

In particular the planar supporting or leveling means serve to guarantee that the axis around which the distributor disk rotates is perfectly orthogonal to the plane in which the distributor disk rotates.

A further variant provides positioning means which contribute to the correct positioning of the distributor disk with respect to the intermediate means.

The positioning means serve to guarantee the precise and constant reciprocal position of the distributor disk (radial position of the holes that temporarily contain the tablets) and intermediate means.

According to a variant, axial positioning assembly is also provided which guarantee that the disk is always in the desired and required vertical position with respect to the strip.

According to other variants, the planar supporting or leveling means can be associated to one or more of either positioning means, centering means and axial positioning assembly, guaranteeing that the disk rotates on a single plane orthogonal to the axis of rotation, that the distributor disk positions itself vertically in the desired and required position with respect to the strip containing the alveoli, that the distributor disk has the axis of rotation coinciding with the axis of rotation of the member which supplies the motion, and that an organized series of holes in the distributor disk is positioned in a desired geometrical manner with respect to the intermediate means.

According to the invention, the intermediate means connect to the means which supply the motion in a removable way, but using reference means which guarantee the reciprocal coaxiality, preventing lateral and/or angular listing and, cooperating with the planar supporting or leveling means, guaranteeing both the correct vertical position of the distributor disk and the coaxiality of the distributor disk with the means which supply the motion.

The intermediate means, according to a variant have vertical positioning means which guarantee that the distributor disk is in the desired and exact vertical position with respect to the strip which holds the alveoli.

According to a variant, the member which supplies the motion is an intermediate member between the motor means and the intermediate means.

In this case, the member which supplies the motion most connect to the motor means by means of means which guarantee exact coaxiality, as well as the vertical positioning of the connection means to the intermediate means.

This means that the means which guarantee the exact coaxiality must have support means and centering means which guarantee this condition.

According to a further variant, between the member which supplies the motion and the motor means angular reciprocal positioning means are provided, so that the chain of motion is geometrically positioned in order to guarantee the correctness of the automatic zero reset.

According to a further variant, the member which supplies the motion is advantageously connected to the intermediate means by means of screws or other rapid and easy replacement means.

BRIEF DESCRIPTION OF THE DRAWINGS

These and other characteristics of the present invention will now be described in detail, with reference to a particular form of embodiment, given as an example, with the help of the attached drawings wherein.

DETAILED DESCRIPTION OF A PREFERENTIAL FORM OF EMBODIMENT

Figure 1:
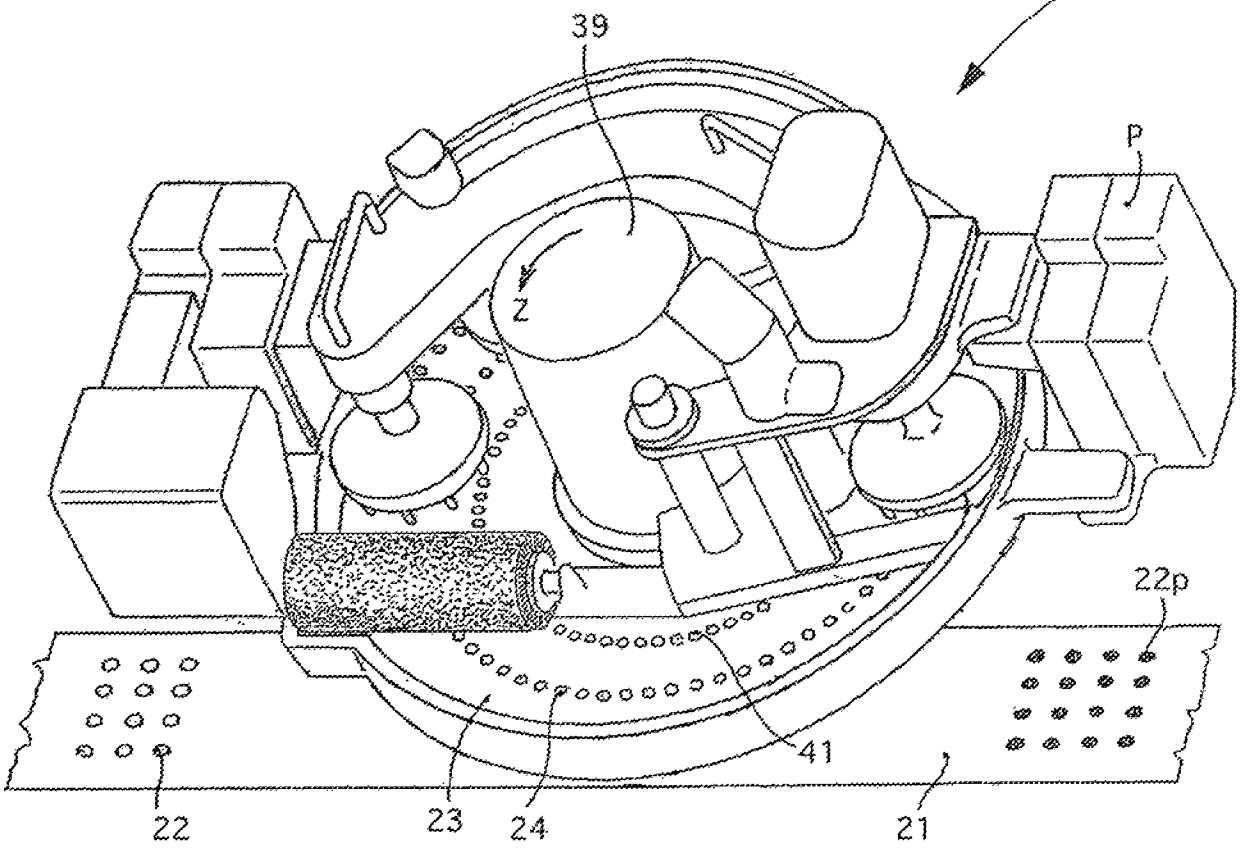
fig. 1 PRIOR ART
FIG. 1 shows a compact distributor unit of the known type.

With reference to FIG. 1, a compact distributor unit 10 is shown comprising a distributor disk 23, for example of the type shown and described in WO-A1-2009/115445.

In the following description the case of a compact distributor unit is shown, but what follows can also be referred to distributor units of the normal type.

The distributor disk 23 cooperates with a strip 21, which has a plurality of alveoli 22 which, after the strip 21 has passed beyond the distributor disk 23, according to the arrow A, are full with tablets 22*p*.

As it is possible to see from FIG. 1, the unit 10 is extremely compact, so that the spaces are reduced and the travel of the tablets is minimized, so as to cause as little wear as possible to the tablets. The substitution of the distributor disk 23 is facilitated by suitable temporary positioning means P.

Figure 2:
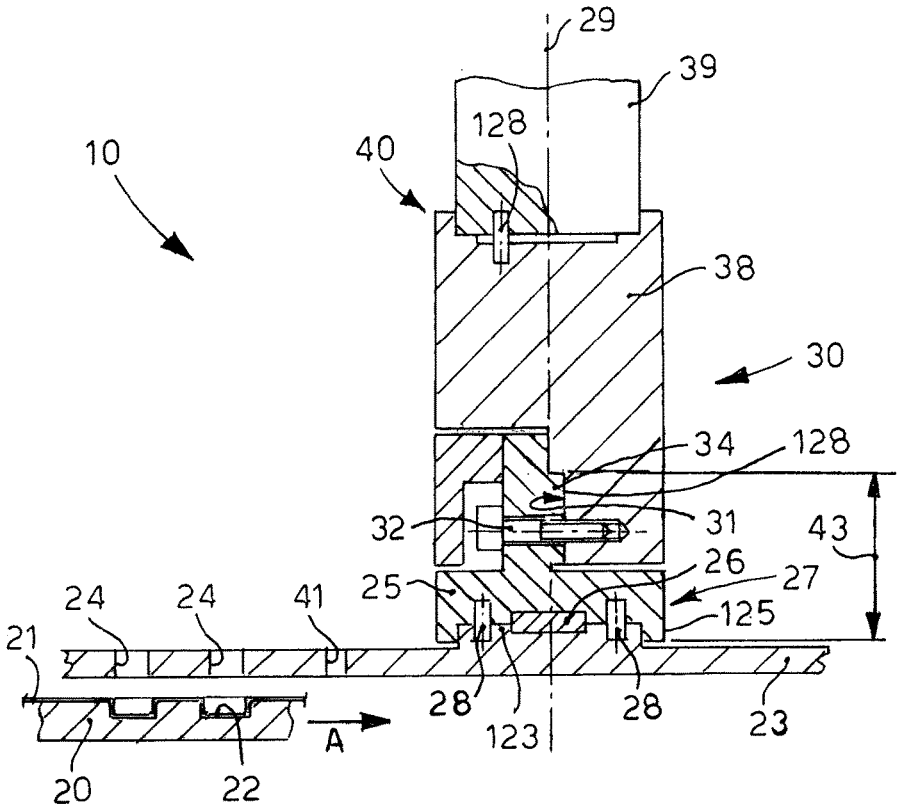
FIG. 2 shows schematically, according to a vertical section, part of the kinematic chain which supplies the motion to the distributor disk.

FIG. 2 shows schematically, and in vertical section, a strip guide 20, on which the strip 21 is caused to slide in a known manner, according to arrow A. The distributor disk 23 has holes 24, organized in rows, for the temporary housing of the tablets, and rotates in a coordinated manner with the advancement of the strip 21, so that the radial seatings of holes 24 and the alveoli 22 periodically find themselves in desired reciprocal positions. In this way, the tablets can be positioned in the alveoli 22 which, downstream of the distributor disk 23, are filled with the tablets 22*p*.

Depending on the size and sequence of the alveoli 22, the distributor disk 23 rotates at a lesser or greater speed.

Figure 5:
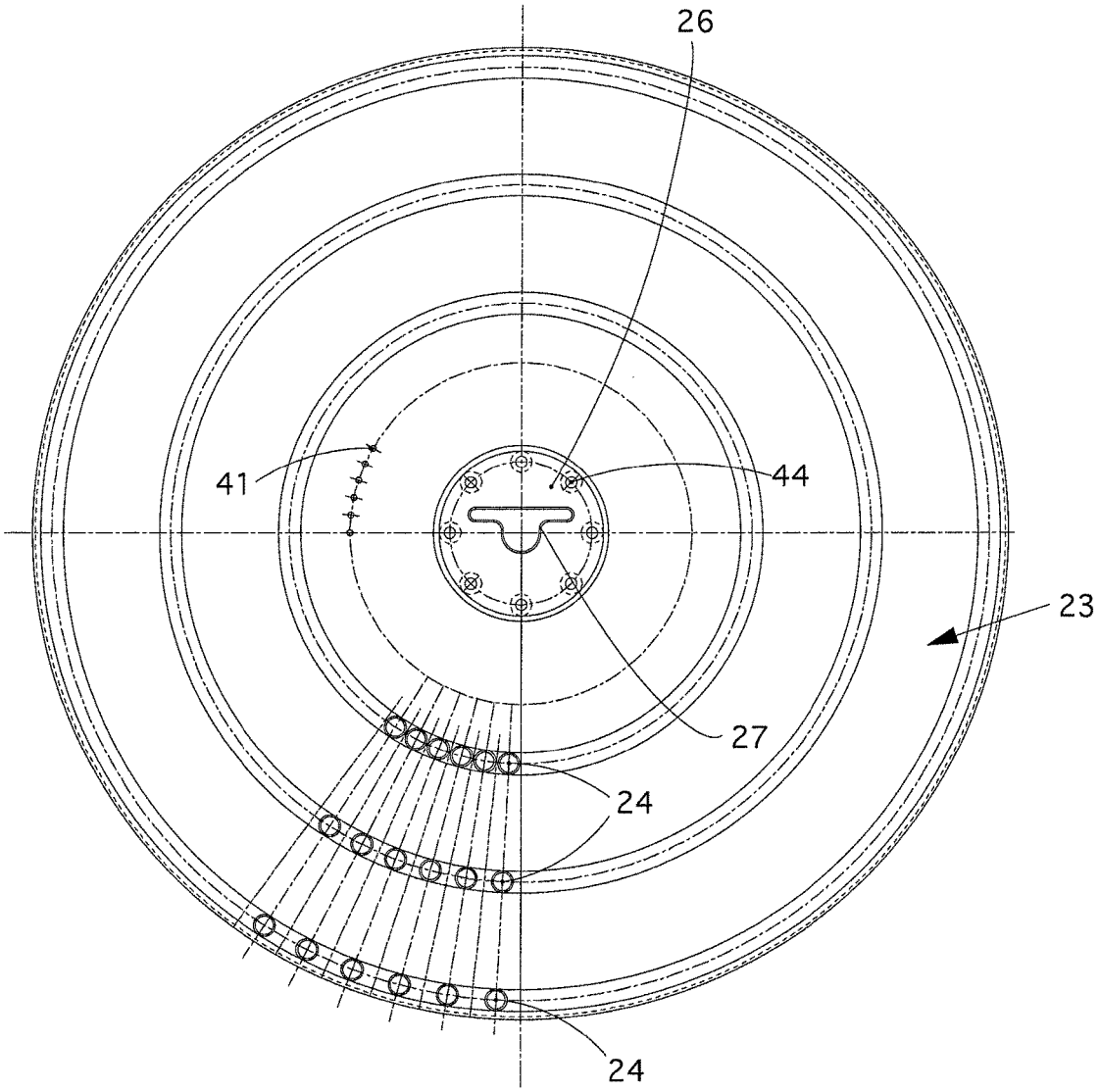
FIG. 5 shows a possible distributor disk.

The distributor disk 23 has zero setting means 41, in this case holes, positioned circumferentially (see FIG. 5), so as to detect the position of the distributor disk 23 and for coordination in time and position and zero setting. The zero setting means 41 can, however, be of any type.

The distributor disk 23 is made solid with intermediate connector 25 using normal screws (not shown), which cooperate with holes 44. The intermediate connector 25 serve to removably connect the distributor disk 23 to the means which supply the rotator motion thereto, indicated in general by the number 30 in FIG. 2, and described in greater detail hereafter.

Although on the one hand they make the distributor disk 23 solid to the intermediate connector 25, the normal screws on the other hand do not guarantee the correct and constant reciprocal positioning.

It should be noted that generally, even if not necessarily, the distributor disk 23 does not have a great thickness, which can even be in the range of ⅔ millimeters.

In order to guarantee a correct ratio of the distributor disk 23/strip 21, planar supporting or leveling means 26, 126 are provided, with a supporting surface, which guarantee that the lying and rotation plane of the distributor disk 23 is parallel to the plane on which the strip 21 slides, and therefore parallel to the strip 21.

For the correct centering, reference means are provided in some embodiments to guarantee the reciprocal coaxiality between the intermediate connector 25 and the means which supply the rotation motion 30.

In particular, in the embodiment of FIG. 2 the reference means comprise two different centering means 27.

Figure 4A:
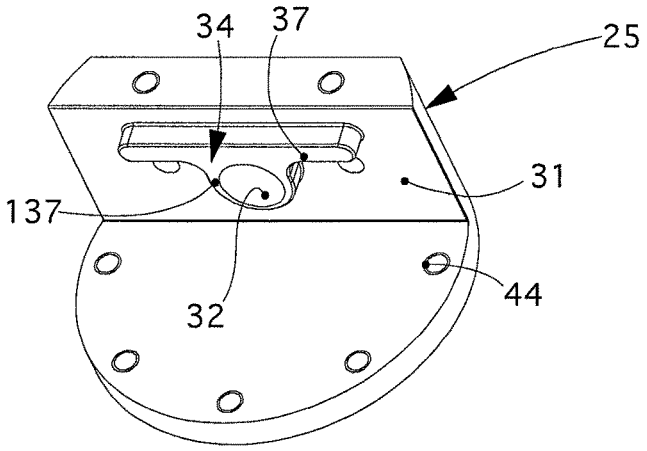
FIG. 4*a* shows a possible intermediate mean.
Figure 4B:
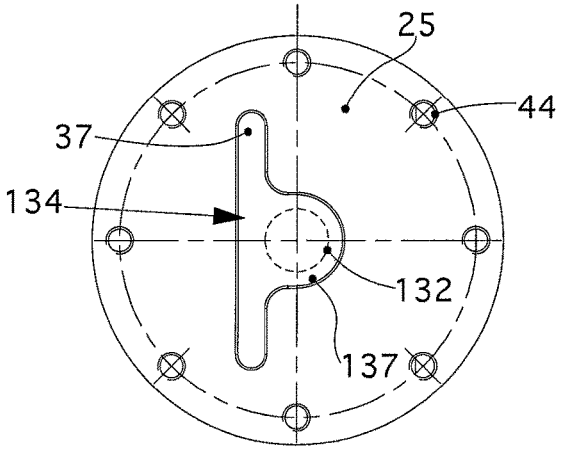
FIG. 4*b* a bottom plan view of the intermediate can of FIG. 4*c;*
Figure 4C:
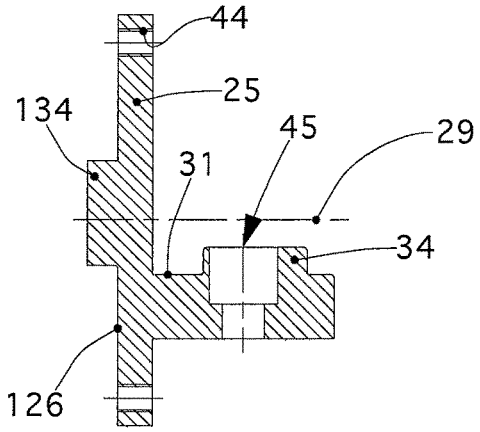
FIG. 4*c* is a section of the intermediate mean of FIGS. 4*a* and 4*b;*

In FIGS. 4*a*, 4*b*, 4*c* there is a further variant, in which the reference means comprise centering and positioning means 134. In this case, the centering and positioning means 134 incorporate the centering means 27, circumferential positioner 28 and also axial positioning assembly 43.

A first type of centering means, denoted with numeral reference 27 in FIG. 2, consists of a male/female coupling (which can be with the male part on the intermediate connector 25 or on the distributor disk 23) of between the intermediate connector 25 and the distributor disk 23, in this case defined by the external edge 125 of the connection means which acts as female seating for an axial central ridge 123 of the distributor disk 23.

The centering means guarantee coaxiality, but do not guarantee the correct and constant reciprocal positioning, in particular the correct angular positioning, of between the distributor disk 23 and the intermediate connector 25, which correct and constant positioning is necessary for each coordination in time and position or zero setting.

In order to guarantee said constant reciprocal positioning it is possible to provide one or more circumferential positioner 28, in this case of the precision key type, between the distributor disk 23 and the intermediate connector 25. According to a variant, the circumferential positioner 28 are of the pin type, for example a pin de-centered with respect to the axis of rotation 29.

In the case of pin-type circumferential positioner 28, according to a variant, advantageously but not necessarily, there will be at least two and located as far as possible from the axis of rotation 29, in order to guarantee the best precision possible, According to a variant, the pins can be also substitutions for the centering means 27, and there may be only one, de-centered.

According to a further variant, there may be only one key, in the case of cooperation with the centering means 27 of the male/female type.

For the connection/disconnection of the intermediate connector 25 and the means which supply motion 30, in order to substitute the distributor disk 23, the coupling is provided by means of reciprocal support surfaces 31 which extend orthogonal to the distributor disk 23.

The orthogonal position between support surfaces 31 and distributor disk 23 facilitates the operations of maintenance and disassembly.

However, other positions can also be assumed, such as angled, stepped, etc.

Advantageously, as in the case shown, the support surfaces 31 contain the axis of rotation 29. The support surfaces 31 themselves do not guarantee either the correct lateral position or the angular position with respect to the support plane, or the correct coaxiality or the correct vertical position.

In order to guarantee this, in some forms of embodiments specific reference means 34, 134 are provided, of which FIGS. 3*a*, 3*b*, 3*c* and 4*a*, 4*b* and 4*c* show some examples of embodiments in order to clarify the spirit of the invention.

The distance between the reference means 34, 134 and the planar supporting or leveling means 26 (in this case) constitute the axial positioning assembly 43.

Figure 3A:
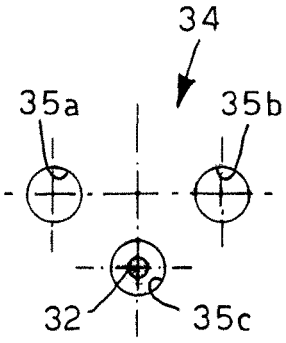
FIGS. 3*a*, 3*b*, 3*c* show three different types of reference means.

In FIG. 3*a* the reference means 34 have three pins 35, respectively 35*a*, 35*b* and 35*c*, located in a triangle with respect to each other, which guarantee the lateral positioning, coaxiality and vertical positioning, and prevent swiveling positions.

Figure 3B:
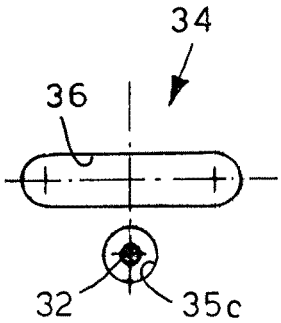
Figure 3C:
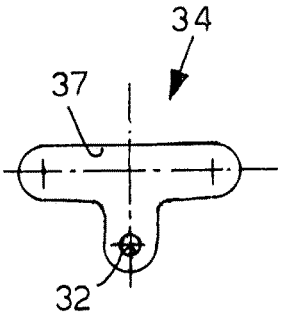

In FIG. 3*b*, instead of the pins 35*a* and 35*b*, the reference means 34 are provided with a calibrated key 36, while in FIG. 3*c* instead of the calibrated key 36 and the pin 35*c*, the reference means are configured as centering and positioning means 34 that are provided in the shape of a T, defined by an elongated element 37 and by an intermediate orthogonal element defining the male element 137 (see also FIG. 4*a*).

The T shape of the centering and positioning means 34 guarantees coupling precision in a vertical direction, a lateral direction and also an angular direction.

This solution therefore allows to eliminate other positioning means in that in itself it guarantees precision on two axes and in angular terms.

This solution is therefore particularly advantageous in order to correctly position the distributor disk 23 with respect to the intermediate connection element 25 without having to provide the means 26, 28 or the external edge 125.

The afore-mentioned centering and positioning means 134, as can be best seen in FIG. 4*b*, can be configured with a T shape as said reference means 34 with T shape of FIGS. 3*c* and 4*a*.

This also simplifies the workings in that the centering and positioning means 34 and the centering and positioning means 134 can be equal or similar.

In the distributor disk 23, the female seating of the centering and positioning means 34 can be blind or through.

If it is through, the seating can cooperate with a shim portion where there is a tablet at the base having a low friction coefficient which serves to support, at least partly, the vertical weight.

Instead of the shim portion, in a male element 137 in the intermediate connector 25 a hole 132 can be provided, in which to place a tablet having a low friction coefficient which serves to at least partly support the weight.

In the case shown, movable attachment means 32 are provided to connect the intermediate connector 25 and an intermediate member 38, the screwing seating of which is in axis with a pin 35*c*, or with a lower extension defining the male element 137 of the T-shaped centering and positioning means 34. The movable attachment means 32 are accessible by means of a removable cover 45, which hides the movable attachment means 32 from sight during the normal functioning of the distributor unit.

According to a variant, in order to facilitate the assembly operations, the means which supply the motion 30 have an intermediate member 38 which connects stably (but in a removable manner) to the motor mean 39. The motor mean 39 can be a motor reducer, or a motor coupled to a reducer.

Between the intermediate member 38 and the motor mean 39, second centering means 40 are provided, for example of the male-female type, similar to the first centering means 27 between distributor disc 23 and intermediate connector 25. The second centering means 40 have, in this case, respective angular positioning means 128 and correct vertical positioning means, As far as regards the second centering means 40, what has already been said for the first centering means 27 applies.

In order to guarantee the coaxiality between motor mean 39 and intermediate member 38, second planar supporting or leveling means can be provided.

Modifications or variants may be made to the present invention, all of which shall come within the field of protection as defined by the following claims.

The invention claimed is:

1. A refined distributor unit which serves to continuously transfer and position tablets or pills in organized alveoli in an advancing strip, said distributor unit comprising:

said advancing strip presenting the alveoli in correspondence with organized holes positioned radially in a rotatable distributor disk to temporarily house said tablets or pills, said advancing strip being arranged below the distributor disk and advancing along an advancement direction;

said distributor disk having setting holes, wherein said distributor disk is associated with a motor which supplies a rotation motion to rotate the distributor disk at a speed coordinated with the advancing of the advancing strip to transfer the tablets or pills from the organized holes of the distributor disk to the alveoli of the strip;

the motor being connected to the distributor disk by an intermediate connector, said intermediate connector being stably connected to the distributor disk and detachably connected, by an intermediate member, to the motor which supplies the rotation motion; and an assembly to provide the stable connection between the distributor disk and the intermediate connector by (i) a female seating configured to receive an axial central ridge of the distributor disk for centering the intermediate connector, (ii) a supporting or leveling member, and (iii) a circumferential positioner, wherein the distributor disk is provided with the axial central ridge able to engage the female seating, and the stable connection between the distributor disk and the intermediate connector is facilitated by the circumferential positioner having positioning pins on the distributor disk and the intermediate connector and by the supporting or leveling member between the positioning pins.

2. The refined distributor unit of claim 1, comprising a reference member having at least three reference points that is capable of coaxially aligning the intermediate connector and the motor which supplies the rotation motion.

3. The refined distributor unit of claim 2, wherein the reference member having at least three reference points is a T-shaped centering and positioning member.

4. The refined distributor unit of claim 1, wherein the assembly is an axial positioning assembly to stably connect the distributor disk and the intermediate connector.

5. The refined distributor unit of claim 1, wherein the circumferential positioner is in contact with a T-shaped male-female positioner.

6. A refined distributor unit comprising:

an advancing strip presenting alveoli in correspondence with organized holes positioned radially in a rotatable distributor disk to temporarily house tablets or pills, said advancing strip being arranged below the distributor disk and advancing along an advancement direction, said distributor disk having setting holes, wherein said distributor disk is associated with a motor which supplies a rotation motion to rotate the distributor disk at a speed coordinated with the advancing of the advancing strip along the advancing direction to transfer the tablets or pills from the organized holes of the distributor disk to the alveoli of the strip;

the motor being connected to the distributor disk by an intermediate connector, the intermediate connector being stably connected to the distributor disk and detachably to the motor which supplies the rotation motion, wherein the intermediate connector includes a male-female centering member; and an assembly to provide the stable connection between the distributor disk and the intermediate connector having at least a female seating configured to receive an axial central ridge of the distributor disk for centering the intermediate connector, a supporting or leveling member, and a circumferential positioner, wherein the distributor disk is provided with the axial central ridge able to engage the female seating, and the stable connection between the distributor disk and the intermediate connector is facilitated by the circumferential positioner having positioning pins on the distributor disk and the intermediate connector and by the supporting or leveling member between the positioning pins.

7. The refined distributor unit of claim 6, comprising:

an axial positioning assembly.

8. The refined distributor unit of claim 6, comprising:

a reference member having at least three reference points that is capable of coaxially aligning the intermediate connector and the motor which supplies the rotation motion.

9. The refined distributor unit of claim 8, wherein the reference member having at least three reference points is a T-shaped centering and positioning object.

10. The refined distributor unit of claim 8, wherein the reference member having at least three reference points comprises at least one of two pins and two holes.

11. The refined distributor unit of claim 8, wherein the reference member having at least three reference points includes at least a calibrated key.

12. The refined distributor unit of claim 6, comprises a supporting surface to cooperate with an axis of rotation.

* * * * *